United States Patent [19]

Kuroda

[11] Patent Number: 4,637,356

[45] Date of Patent: Jan. 20, 1987

[54] VALVE ACTUATING MECHANISM FOR INTERNAL COMBUSTION ENGINE

[75] Inventor: Yuuzoh Kuroda, Kakegawa, Japan

[73] Assignee: Yamaha Hatsudoki Kabushiki Kaisha, Iwata, Japan

[21] Appl. No.: 746,380

[22] Filed: Jun. 19, 1985

[30] Foreign Application Priority Data

Aug. 15, 1984 [JP] Japan ..... 59-169378

[51] Int. Cl.[4] ..... F01L 1/26

[52] U.S. Cl. ..... 123/90.27; 123/90.44; 123/90.22

[58] Field of Search ..... 123/90.27, 90.44, 90.22, 123/90.23, 90.4, 90.6

[56] References Cited

U.S. PATENT DOCUMENTS

| | | | |
|---|---|---|---|
| 1,271,764 | 7/1918 | Pullinger | 123/90.27 |
| 2,103,024 | 12/1937 | Smith | 123/90.27 |
| 3,139,870 | 7/1964 | Sampietro | 123/90.44 |
| 4,549,510 | 10/1985 | Miyakoshi et al. | 123/90.27 |

FOREIGN PATENT DOCUMENTS

| | | | |
|---|---|---|---|
| 296125 | 8/1928 | United Kingdom | 123/90.27 |

*Primary Examiner*—Ira S. Lazarus

*Attorney, Agent, or Firm*—Ernest A. Beutler

[57] ABSTRACT

An improved valve actuating mechanism for an internal combustion engine for operating three closely adjacent valves from three lobes of the same camshaft. The centermost lobe operates its valve through a rocker arm while the outermost lobes directly operate their associated valves.

4 Claims, 4 Drawing Figures

VALVE ACTUATING MECHANISM FOR INTERNAL COMBUSTION ENGINE

BACKGROUND OF THE INVENTION

This invention relates to a valve actuating mechanism for an internal combustion engine and more particularly to an improved and compact arrangement for facilitating the operation of a plurality of closely positioned valves from a single camshaft.

The advantages of using multiple valves for a single combustion chamber of an internal combustion engine are well known. Multiple valves generally provide a greater effective area for a given surface area and lower inertias so as to permit higher operating speeds. It has, therefore, become a practice to employ two intake and/or exhaust valves for each chamber of the engine and, in fact, there has been recently a trend toward employing an even greater number of intake and/or exhaust valves. However, it is essential that the valves be positioned and oriented so that the combustion chamber has a good and yet compact configuration. Also, when a plurality of valves are utilized that are driven by a single camshaft, there is a problem in operating all of the valves effectively and still permitting a close enough placement of the valves.

It is, therefore, a principal object of this invention to provide an improved valve actuating mechanism for an internal combustion engine.

It is a further object of this invention to provide a valve actuating mechanism for an internal combustion engine that permits the use of a plurality of closely spaced valves that are driven by a single camshaft.

SUMMARY OF THE INVENTION

This invention is adapted to be embodied in an internal combustion engine having three poppet type valves all operated from three adjacent cam lobes of a single camshaft. In accordance with the invention, the centermost cam lobe operates its valve through a rocker arm whereas the remaining cam lobes operate their valves directly.

DETAILED DESCRIPTION OF THE PREFERRED EMBODIMENT

Figure 1:
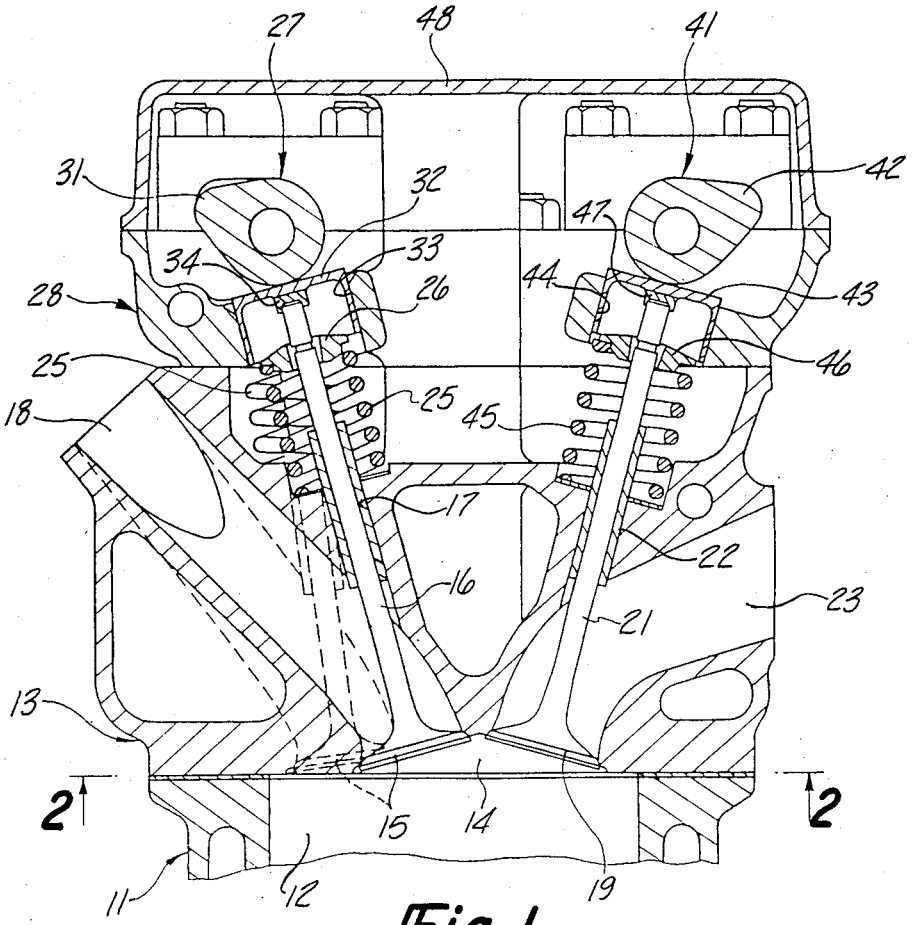
FIG. 1 is a cross-sectional view of a portion of an internal combustion engine constructed in accordance with an embodiment of the invention and taken generally along the line 1—1 of FIG. 4.

Inasmuch as the invention relates to the valve and valve actuating mechanism of an engine, only this portion of the engine has been shown in detail in relationship to the associated components and only the construction associated with a single cylinder has been illustrated. The application of this invention to multiple cylinder engines of varying cylinder configurations is believed to be readily apparent to those skilled in the art from the following description.

In the drawings, the reference numeral 11 indicates generally a cylinder block that is formed with one or more cylinder bores 12 in which pistons reciprocate and which are connected in a known manner to the associated crankshaft. As noted above, since these components form no portion of the invention, they have not been illustrated nor will they be described in any further detail since they are conventional.

A cylinder head assembly, indicated generally by the reference numeral 13, is affixed in a suitable manner to the cylinder block 11. The cylinder head 13 has one or more cavities 14 that cooperate with each of the cylinder bores 12 and their associated pistons to provide chambers of varying volume, hereinafter referred to as the combustion chambers.

A plurality of, and in the illustrated embodiment, three intake valves 15 are supported within the cylinder head 13 with the heads of the intake valves 15 lying generally on one side of a plane containing the axis of the cylinder bore 12. The intake valves 15 each have respective stems 16 that are slidably supported in valve guides 17 that are pressed into the cylinder head. The intake valves 15 control the flow of a fuel/air mixture to the combustion chamber 14 through an intake passage arrangement 18 which may be of any desired configuration.

A plurality of, and in the illustrated embodiment, two exhaust valves 19 are also supported in the cylinder head assembly 13 with the exhaust valves 19 being disposed on the opposite side of the aforedescribed plane from the intake valves 15. Like the intake valves, the exhaust valves 19 have stem portions 21 that are slidably supported within guides 22 formed in the cylinder head assembly 13 for controlling the flow of exhaust gases from the combustion chamber 14 through exhaust passages 23.

Figure 2:
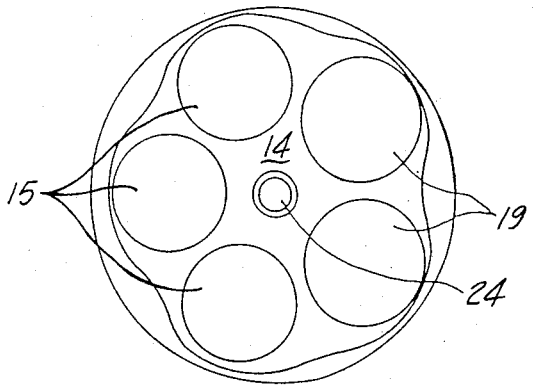
FIG. 2 is a cross-sectional view looking in the direction of the line 2—2 in FIG. 1 and shows the combustion chamber configuration.
Figure 3:
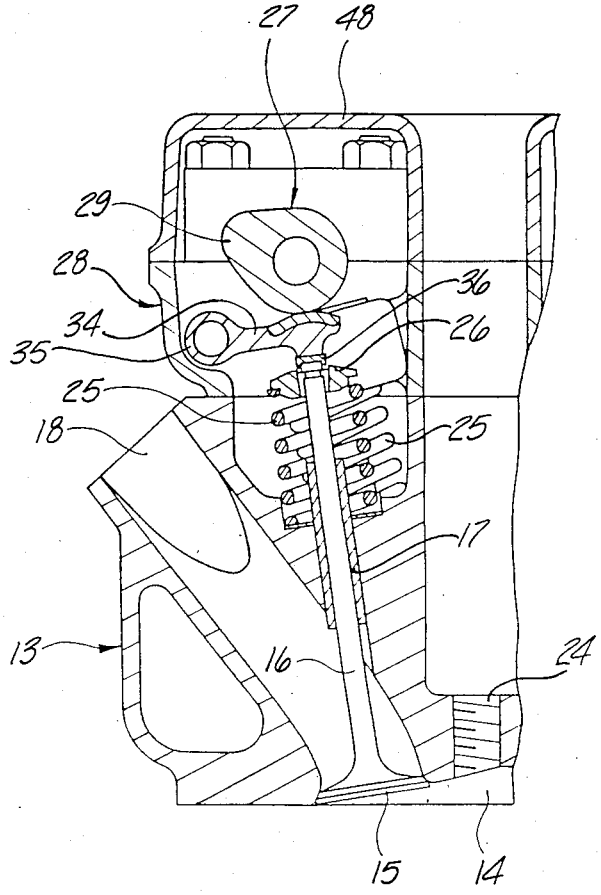
FIG. 3 is a cross-sectional view taken along the line 3—3 of FIG. 4.

The orientation of the intake valves 15 and exhaust valves 19 is particularly important in insuring a suitable combustion chamber configuration and one which will be relatively small in clearance volume and surface area and which will nevertheless permit free movement of the valve 15 and 19. Preferably the valves 15 and 19 are disposed as described in the embodiments of FIGS. 1 through 3 of copending Application Ser. No. 369,665, filed Apr. 19, 1982 in the name of Yoshikawa Masaaki, entitled "Four-Cycle Engine" and assigned to the same assignee of this application. Because the orientation of the valves is adequately described in that application, which is herein incorporated by reference, it will not be described again in detail.

A spark plug opening 24 is formed in the cylinder head assembly 13 approximately at the axis of the cylinder bore 12. A spark plug (not shown) is positioned within the opening 24 with its gap disposed in the combustion chamber 14 for firing the charge in a known manner.

Coil compression springs 25 encircle the stems 16 of each of the intake valves 15 and act against keeper retainer assemblies 26 and the cylinder head 13 for urging the intake valves 15 toward their closed position. The intake valves 15 are operated, in a manner to be described, by means of an intake camshaft, indicated generally by the reference numeral 27 which camshaft is supported by means of a cam box 28 that is affixed to the upper side of the cylinder head assembly 13 in a known manner. As noted in the aforedescribed copending application, the intake valves 15 are disposed so that the axes of reciprocation defined by the stems 16 and guides 17 all intersect at a common line, this line being the axis of rotation of the camshaft 27.

Figure 4:
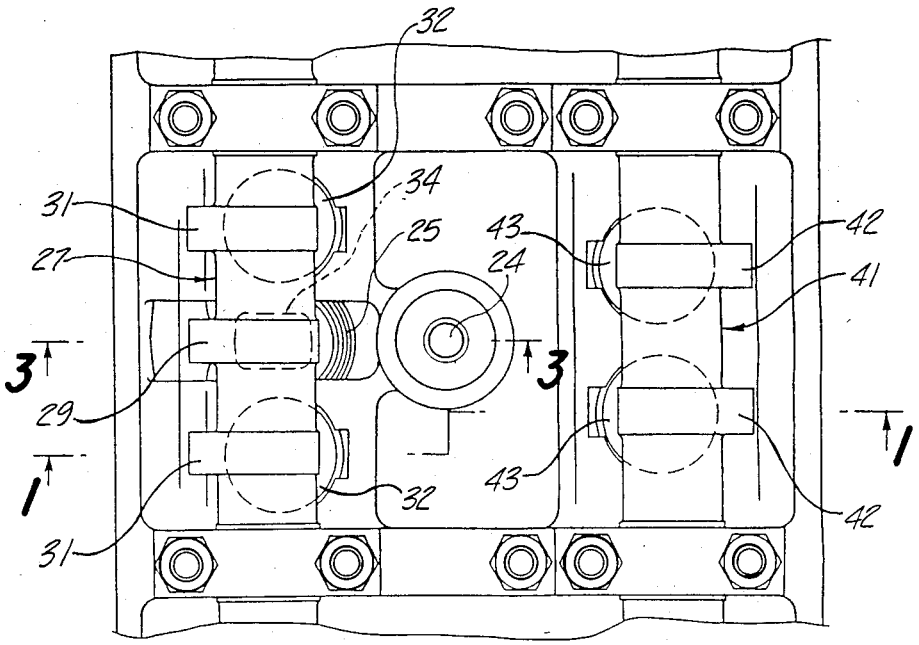
FIG. 4 is a top plan view of the cylinder head assembly with the camshaft cover removed.

As viewed in FIG. 4, the camshaft 27 is provided with three axially spaced cam lobes consisting of a center lobe 29 and end lobes 31 that are associated with each of the intake valves 15 and which operate them in a manner now to be described.

The outer lobes 31 operate their respective intake valves 15 directly by means of thimble tappets 32 that are slidably supported in respective bores 33 formed in the cam box 28. Suitable adjusting shims 34 are provided between the tips of the valve stems 16 and the thimble tappets 32 for effecting clearance adjustment in a known manner.

The centermost intake valve 15 and its associated cam lobe 29 interact by means of a pivotally supported rocker arm 34 that is supported by means of a pivot shaft 35 at one side of and below the intake camshaft 27. An adjusting shim 36 is interposed between the tip of this intake valve stem 16 and the rocker arm 34 for clearance adjustment.

The described operating structure wherein one of the intake valves 15 is operated by a rocker arm and the others are directly operated by thimble tappets permits good operation of all valves in a very close arrangement. It should be readily apparent from FIG. 4 that thimble tappets could not be employed for operating each of the intake valves without significantly increasing the length of the engine and/or positioning the outermost valves too far outwardly in the combustion chamber 14.

Inasmuch as there are only two exhaust valves 19, it is possible to operate each of these exhaust valves directly from an overhead mounted exhaust camshaft, indicated generally by the reference numeral 41, and having two cam lobes 42. The camshaft 41 is suitably journaled within the cam box 28 and thimble tappets 43 are slidably supported in bores 44 of the cam box 28 and are interposed between the cam lobes 42 and the stems 21 of the exhaust valves 19.

The exhaust valves 19 are urged toward their closed position by means of coil compression springs 45 that encircle the stems 21 and act against keeper retainers 46 and the cylinder head assembly 13. Shims 47 are interposed between the upper ends of the stems 21 and the thimble tappets 43 for providing clearance adjustment.

The camshafts 27 and 41 and cam box 28 are enclosed by means of a cover assembly 48 that is affixed to the cam box 28 in any suitable manner.

It should be readily apparent from the foregoing description that the described arrangement for operating the intake valves permits these valves to be positioned closely adjacent each other and yet allows them to be operated in an effective manner. The same construction could also be employed with the exhaust valves if three exhaust valves were employed in a given cylinder.

It should be understood that the foregoing description is that of a preferred embodiment and that various changes and modifications may be made without departing from the spirit and scope of the invention, as defined by the appended claims.

I claim:

1. An internal combustion engine comprising a cylinder having a bore, a cylinder head fixed relative to said cylinder, three poppet type valves supported by said cylinder head for reciprocation about respective axes all positioned on the same side of a plane containing the axis of said cylinder bore, a single camshaft having three respective cam lobes each associated with a respective of said valves, said camshaft being rotatable about an axis extending parallel to said plane and lying on said same side thereof as said valve axes, rocker arms means associated with one of the cam lobes for operating its associated valve, and means for directly operating the remainder of said valves from the remaining cam lobes.

2. An internal combustion engine as set forth in claim 1 wherein the valves all serve the same function.

3. An internal combustion engine as set forth in claim 1 wherein the centermost valve is operated by the centermost cam lobe via the rocker arm means and the remainder of the valves are operated directly from the remaining cam lobes by means of followers slidably supported in the cylinder head.

4. An internal combustion engine as set forth in claim 1 wherein the rocker arm is supported for pivotal movement about an axis parallel to the plane and offset from the plane away from the rotational axis of the camshaft.

* * * * *